US005421464A

United States Patent [19]

Gillmann et al.

[11] Patent Number: 5,421,464

[45] Date of Patent: Jun. 6, 1995

[54] METHOD FOR SEQUENCING LETTERS IN MAIL-SORTING FACILITIES

[75] Inventors: Hanno Gillmann, Constance; Ottmar Kechel, Stockach, both of Germany

[73] Assignee: Licentia Patent-Verwaltungs-GmbH, Frankfurt, Germany

[21] Appl. No.: 187,558

[22] Filed: Jan. 28, 1994

[30] Foreign Application Priority Data

Jan. 28, 1993 [DE] Germany ..... 43 02 231.6

[51] Int. Cl.[6] ..... B07C 5/00; B65H 5/22

[52] U.S. Cl. ..... 209/584; 209/900; 271/3.1

[58] Field of Search ..... 209/563, 564, 583, 584, 209/630, 900; 198/418.2, 449; 271/3, 3.1, 9, 35

[56] References Cited

U.S. PATENT DOCUMENTS

| | | | |
|---|---|---|---|
| 3,913,725 | 10/1975 | Harrison | 198/449 X |
| 5,097,959 | 3/1992 | Tilles et al. | 209/584 |
| 5,097,960 | 3/1992 | Tilles et al. | 209/900 X |
| 5,119,954 | 6/1992 | Svyatsky et al. | 209/584 |

FOREIGN PATENT DOCUMENTS

| | | |
|---|---|---|
| 3823644 | 1/1990 | Germany . |
| 3205651 | 12/1990 | Germany . |
| 4236507 | 12/1993 | Germany . |

OTHER PUBLICATIONS

J. Strohmeyer and J. Nice, Carrier Sequence Bar Code Sorter, Feb. 12, 1992, pp. 1061–1074, Advanced Technology Conference.

*Primary Examiner*—James R. Bidwell
*Assistant Examiner*—Tuan N. Nguyen
*Attorney, Agent, or Firm*—Spencer, Frank & Schneider

[57] ABSTRACT

In the method of the invention for sequencing parcels in mail-sorting facilities having rows of stacking compartments, a sorting plan is used for sorting the parcels in which an overfilling of the individual stacking compartments is avoided so that, during one sorting procedure, the stacking compartments are not emptied, and that, after a sorting procedure has ended, an in-sequence transfer of the parcels is effected from the stacking compartments into a conveying device disposed opposite the stacking compartments or into containers.

7 Claims, 2 Drawing Sheets

METHOD FOR SEQUENCING LETTERS IN MAIL-SORTING FACILITIES

BACKGROUND OF THE INVENTION

The invention relates to a method for improved sequencing of letters in mail-sorting facilities.

In mail-sorting facilities, mailed items, particularly letters, are sorted in a pre-sorting procedure and deposited into a number of stacking compartments. The extent of sorting that can be achieved is determined by the number of stacking compartments into which the mailed items are distributed. Often it is neither desired nor possible, for practical reasons, to provide each of the smallest classes of a sorting procedure with its own sorting compartment. For example, when the mailed items are to be sorted corresponding to the sequence of a distribution in the postal route, a separate sorting compartment for each mail recipient is not necessary. Rather, the mailed items are distributed into a specific number of stacking compartments in the same sequence in which they will later be distributed by the sorter during the distribution process. The mailed items are arranged inside each sorting compartment to correspond to the stipulated sequence so that, in a corresponding arrangement of the stacking compartments, all of the mailed items are arranged according to the stipulated sequence. To permit sorting facilities to use a relatively small number of stacking compartments, the mailed items are sorted multiple times and possibly indirectly, as described, for example, in the Proceedings USPS Advanced Technology Conference, Washington, D.C., of Dec. 2, 1992, pp. 1061–1974.

Mail-sorting facilities are known in which the stacking compartments are disposed opposite the mail input, so that after each sorting procedure that is followed by a further sorting procedure, the mailed items can be quickly taken manually from the stacking compartments and reinserted into an input module. In manual transfer, the mailed items are respectively transferred by the handful from the compartment into containers opposite the stacking compartments and that are mounted on a mobile base. It is conventional that the containers possess a larger holding capacity than the stacking compartments, which must be emptied multiple times for transfer during each sorting procedure. A prerequisite for sequencing in accordance with the above-described method is that the sequence of the parcels be strictly maintained, i.e., the sequence integrity after the first and all subsequent sorting procedures. It is thus necessary that the containers be brought back into the correct sequence after each sorting procedure with the mobile base or additional transport means for mail input, or sorted into suitable groups for further processing after the last sorting procedure. Particular drawbacks of the prior art are that at least two operators are required for mail input and emptying the compartments. Further, restacking or interim stacking of the mailed items in containers requires a greater space requirement and increases the risk of disturbing the sequence integrity, because the stacks in the containers can easily capsize when the container is only partly filled, and the produced sequence can thus be disturbed. Further, the stacks can inadvertently be loaded into the wrong containers, or the sequence of the containers can be disturbed.

SUMMARY OF THE INVENTION

The object of the present invention is a method that avoids the described drawbacks of the prior art and permits a simple, fast and reliable sequencing of the mailed items with retention of the sequence integrity. In comparison to the prior art, the method of the invention has the advantage that only one operator is required, that practically no partially-filled containers result, that the risk of disturbing the sequence integrity is reduced, and that less space is required.

The object is attained by providing a method for sequencing parcels in aisle sequence during a plurality of sorting procedures in mail-sorting facilities that have rows of stacking compartments. The method comprises the steps of sorting the parcels into the stacking compartments in accordance with a plan in which every or almost every one of the stacking compartments is filled at the most to its maximum filling capacity during a sorting procedure. If a stacking compartment is filed to overflowing, it is allocated an overflow compartment, in which the further stacking is effected. During one sorting procedure the stacking compartments are not emptied. After the end of a sorting procedure, an aisle-sequence transfer of the parcels from the stacking compartments into a conveying device disposed opposite the stacking compartments or into containers is performed.

The invention is based on the idea of not emptying the stacking compartments during the sorting procedure in a sequencing method, and using a sorting plan in which, if possible, no stacking compartment is filled to overflowing or overflows, and after the sorting procedure has ended, directly transferring the contents of the stacking compartments in sequence into a conveying device that serves the input module or into containers, and supplying the contents in sequence to the input module or for further processing.

The invention is described in detail below by means of drawings.

DETAILED DESCRIPTION OF THE PREFERRED EMBODIMENT

Figure 1:
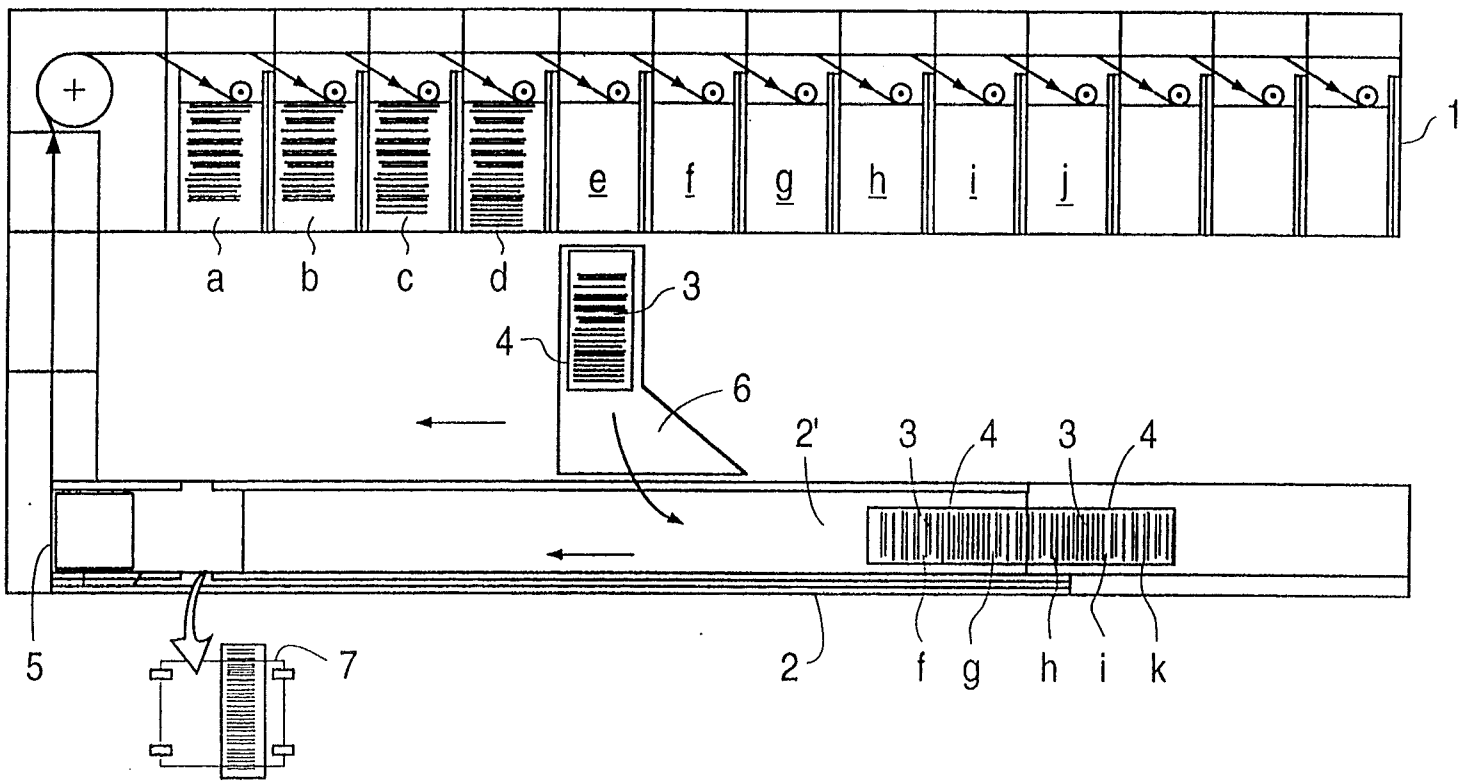
FIG. 1 shows a mail-sorting facility for executing the method of the invention.

FIG. 1 schematically shows a mail-sorting facility for executing the method of the invention, in which a number of stacking compartments 1 are disposed opposite a conveying device 2, with which the parcels 3, which have been filled into transport containers 4, are transported to the input module 5. A transfer bridge 6, as is known, for example, from DE 4,236,507, is disposed between the stacking compartments and can be moved along the row of stacking compartments 1. Transfer bridge 6 serves in the fast and reliable transfer of the parcels from the stacking compartments 1 into the containers 4, and subsequent transport to the conveying device 2.

For simplification, the invention is described below by way of an example of sequencing in two sorting procedures, because it is apparent to a person skilled in the art how the method is to be generalized for more than two sorting procedures. As is conventional, in the first sorting procedure, sorting is performed according to the least significant digit (LSD). The sorting plan is designed such that, if possible, individual stacking compartments are prevented from being filled to overflowing. Such an optimization is possible because, in accordance with the invention, the mail volume for specific destinations only fluctuates by limited amounts from statistical mean values determined by means of measurements and that can be the basis of the sorting plan. In the method of the invention, no compartment is emptied during the first sorting procedure. After the end of the sorting procedure, the parcels are transferred directly from the stacking compartments 1 into the containers 4 by means of the transfer bridge 6, and compartments are emptied in sequence one after the other into a container until it is full. The transfer bridge forms a throughgoing glide path between a stacking compartment and the conveying device located opposite, respectively. In this way the occurrence of partially-filled containers is extensively avoided. Thus, possible problems with stacks of mailed items tipping over inside the containers is minimized. The filled containers are disposed one behind the other in the conveying device 2. A conveyor belt 2′ whose width approximately corresponds to the width of the used transport container 4 is preferably provided for this device. The emptying of the compartments into the containers and the arrangement of the containers inside the conveying device, that is, on the conveyor belt 2′, is effected in sequence. If, for example, the LSD includes the elements a, b, c, d, e, f, g, h, i, k in ascending order, as shown in FIG. 1, emptying of the compartments is effected in the order k, i, h, g, f, e, d, c, b, a, and the parcels are arranged in each container such that the highest elements of the LSD are stacked at the end of the container, the lowest at the front. The containers are placed on the conveyor belt such that the end of a container that is newly-placed onto the conveyor belt is contiguous with the front side of a container already located on the conveyor belt. Such an arrangement is preferably achieved in that the transfer bridge has a funnel-shaped, asymmetrical extension. By this compulsory arrangement and conveyance of the containers, it is avoided that the sequence of containers and thus the sequence integrity is disturbed. The described type of transfer is realized in a mail-sorting facility in FIG. 1 in the following manner: the transfer bridge 6 is moved along the row of stacking compartments by an operator in such a way that the sequence k, i, h, g, f, e, d, c, b, a of the stacking compartments is followed, that is, from right to left in FIG. 1. The operator goes behind the bridge 6, lifts with the right hand the separating blade typically used in the stacking compartments to stabilize the parcels, supports the stacked parcels with the left hand, returns the separating blade to its initial position, and subsequently pushes the parcel stack with both hands into the container located on the bridge. In case the parcel stack does not fit completely into the space available in the container, first a part of the stack is removed from the compartment, and the remainder is again secured with the separating blade. The filled container is pivoted onto the conveyor belt, corresponding to a pivoting motion of the operator toward the left, as is the case in FIG. 1, so that the last parcel inserted into the container is on the side of the container facing the input module. Subsequently the operator takes an empty container and begins to fill it with the remaining parcels. The conveyor belt 2 preferably ends in front of the input module, so that the containers can simply be pushed or transferred into the module.

In the second sorting procedure, the parcels are sorted according to the most significant digit (MSD) and placed in the stacking compartments, wherein it is assured by means of a correspondingly optimized sorting plan that, if possible, the stacking compartments also do not overflow in the second sorting procedure. After the end of the sorting procedure, the compartments are emptied in the same manner into the containers, and the containers are placed onto the conveyor belt as in sorting procedure 1. The containers are removed from the sorting belt according to sequence, transferred into appropriate carts 7 and supplied for further processing.

Of course, the method of the invention is not limited to the use of containers. Rather, it is possible in accordance with sorting procedure 1 to remove the parcels directly from the stacking compartments 1 and push them via a transfer bridge onto the conveyor belt 2, so that the parcels are subsequently supplied in sequence to the input module. For this it is only required that the parcel stacks lie closely together on the conveyor belt 2 so that tipping of the parcels is prevented. This can be achieved, for example, by means of a correspondingly controlled later guidance of the conveyor belt 2, by which the parcels 3 lying on the conveyor belt 2 are guided to the transfer bridge 6 when the respective stack pair is emptied.

Illustrated below is the dimensioning of a mail-sorting facility having 200 stacking compartments that have a respective stack capacity of 350 parcels for the case of 2000 or 1500 parcels per sorter.

In a system having 200 stacking compartments per 350 loads, a maximum of 70,000 parcels can be processed in a sequencing procedure. In order to have reserves for different parcel thicknesses and compartments to be filled to different capacities, only 70% of the maximum capacity, that is, approximately 50,000 parcels, are processed. It is assumed that each sorter services 800 destinations. This means that, for example, with a number of 2000 parcels per sorter, 25 sorters are required for each sequencing procedure. With 200 stacking compartments, it is known that a maximum of 200·200 destinations are available (see, for example, Proceedings USPS Advanced Technology Conference, Washington, Dec. 2, 1992, pp. 1061–1074). The situation for the above-described different numbers of parcels for sorters has been compiled as an overview in the following table.

| Example | A | B |
|---|---|---|
| Parcels/Sorter* | 2,000 | 1,500 |
| Delivery Destinations/Sorter | 800 | 800 |
| Total Number of Delivery Destinations | 20,000 | 26,400 |
| Available (200 · 200) | 40,000 | 40,000 |

* = Average Values

It can be seen from the table that in example A, two more compartments per location can be omitted in the first sorting procedure, in example B two more compartments for every second location. In such a case the first compartment is first filled, then steered toward the second, contiguous stacking compartment. The sequencing procedure for example A will be explained in more detail below. In the first sorting procedure, what is placed into the compartments is

| | |
|---|---|
| 1 + 2: | DSN 001, 101, 201, 301, 401, 501, 601, 701 |
| 3 + 4: | DSN 002, 102, 202, 302, 402, 502, 502, 702 |
| 5 + 6: | DSN 003, 103, 203, 303, 403, 503, 603, 703 |
| etc. | |
| 199 + 200: | DSN 100, 200, 300, 400, 500, 600, 700, 800 |

wherein the destinations of the sorter are numbered with DSN (delivery sequence number).

Figure 2:
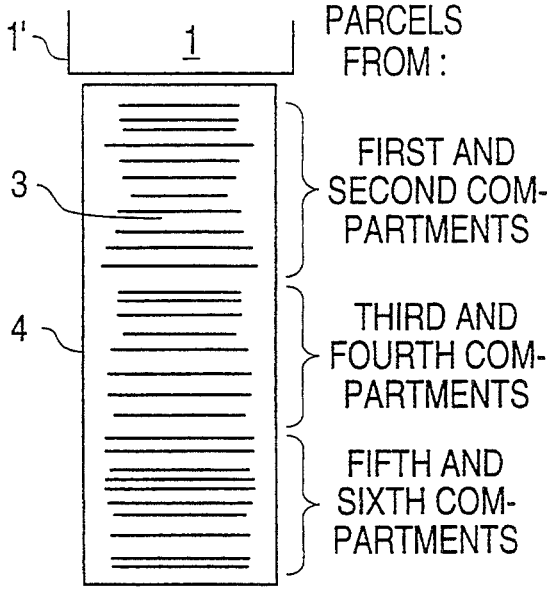
FIG. 2 illustrates the allocation of the contents of a container to the individual stacking compartments after unloading the compartments for the case that two compartments are assigned to each (destination)

As already described above, transferring the parcels into the containers begins at the rear, so that the highest values of the DSNs are stacked at the end of the container, and the lowest, in contrast, at the front. For example A, FIG. 2 shows the parcels 3 of a container 4 after the first through sixth compartments have been emptied, wherein the first stacking compartment is indicated by 1'. The contents of the first and second stacking compartments are stacked at the end of the container, while the contents of the first and second stacking compartments are located at the front. Thus, if the mailed items are removed from the container after the first sorting procedure, the contents of stacking compartment 1 are distributed as the first in sorting procedure 2, and are located at the front end of the respective stacking compartments in which the parcels have been stacked.

Figure 3:
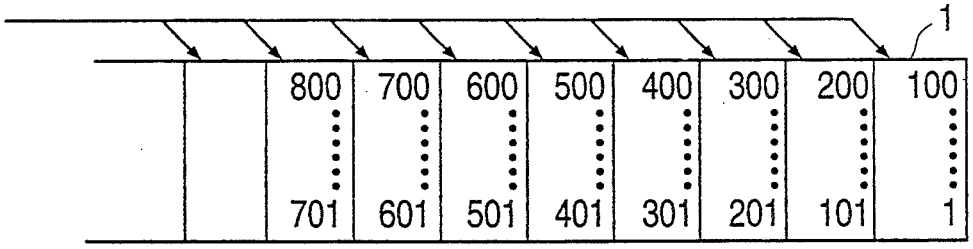
FIG. 3 shows the sequence of the sequenced parcels in the stacking compartments for an 800-destination route.
Figure 4:
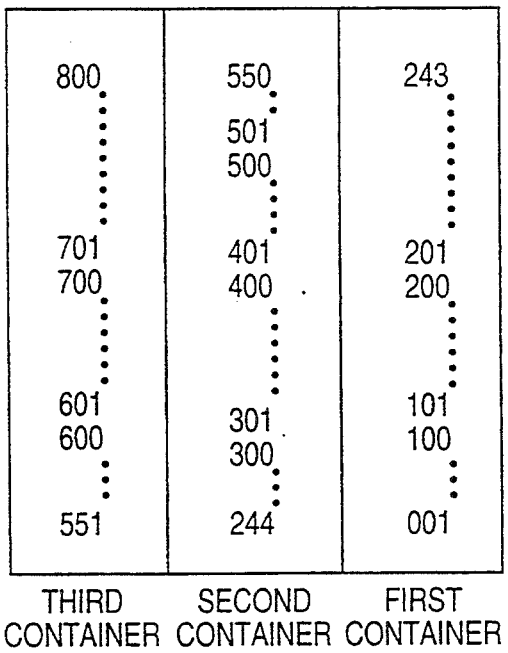
FIG. 4 shows the sequence of the sequenced parcels in the containers for an 800-destination route.

In the second sorting procedure, each sorter in example A has eight compartments into which the parcels are sorted, as shown in FIG. 3. Afterwards, the parcels with DSNs of 1–100 are sorted into a first compartment, those with DSNs of 101–200 are sorted into a second compartment, etc., the parcels with DSNs of 701–800 are sorted into an eighth compartment. Sorters that only have to supply 700 or 600 DSNs correspondingly require less compartments; with more than 800 DSNs, correspondingly more compartments are needed. To achieve an in-sequence arrangement of the parcels in containers, transferring from the stacking compartments of FIG. 3 into the containers is effected from right to left. The resulting sequence of the parcels in the containers is shown as an example in FIG. 4. Furthermore, the parcels having the lowest DSNs are stacked in the front part of the containers, and those having higher ones are stacked in the rear part of the containers.

In the method of the invention, with an appropriately optimized sorting plan it is ensured that it is very unlikely that the compartments will be overfilled. For the improbable case that overfilling does occur, two to three free overflow compartments can be allocated per row of stacking compartments that are inserted into the sequence by means of appropriate signalizing when the compartments are emptied. Therefore, in case a stacking compartment is filled to overflowing, one of the free overflow compartments, in which the corresponding parcels are subsequently stacked, is allocated to this location (destination). When the stacking compartments are emptied, the operator is instructed by means of a blinker lamp, for example, to remove the overflow compartment and to quit. Which overflow compartment is to be removed is displayed in the stacking compartment display. Consequently, there are only a few exceptions in the sequence of emptying the stacking compartments, while in general no change is necessary during the course of the procedure.

For particularly simple and reliable emptying of the stacking compartments, the stack container known from DE 3,823,644, which has a movable bottom, is preferably used. This container permits direct stacking of the parcels from the stacking compartment without the parcels needing to be lifted by the operator or lifted above the edge of the container. Moreover, the use of these containers also permits the parcels to be pushed directly from the container into the input compartment of the input module. Because the parcels are oriented toward the stack edge when inside the container, reorientation of the parcels is not necessary.

In the above description, for simplification of a mail-sorting facility having only one row of stacking compartments is the point of departure. However, multiple-level arrangements of the stacking compartments are conventional. Correspondingly, in the method of the invention, a height-adjustable transfer bridge 6 is used with which the glide plane of the transfer bridge can be raised or lowered, respectively, to the level of the stacking compartment bottom. Correspondingly, a conveying device or a conveying belt is disposed opposite each stacking compartment row (grouping). To go from the different heights of the conveying belts to the height of the input device, a movable height-compensating bridge is used.

We claim:

1. Method for sequencing parcels in aisle sequence during a plurality of sorting procedures in mail-sorting facilities that have rows of stacking compartments, comprising the steps of:

sorting of the parcels into the stacking compartments in accordance with a plan in which substantially every one of the stacking compartments is filled at the most to its maximum filling capacity during a sorting procedure, wherein, in case a stacking compartment is filled to overflowing, it is allocated an overflow compartment, in which the further stacking is effected;

during one sorting procedure the stacking compartments are not emptied; and performing after the end of a sorting procedure, an aisle-sequence transfer of the parcels from the stacking compartments into a conveying device disposed opposite the stacking compartments or into containers.

2. Method in accordance with claim 1, further comprising the step of moving a transfer bridge along the row of stacking compartments for transfer into the conveying device or the containers.

3. Method in accordance with claim 1, further comprising the step of filling the respective containers to their maximum receiving capacity during transfer.

4. Method in accordance with claim 1, further comprising the step of visibly signaling an operator in the event stacking has taken place in an overflow compartment.

5. Method in accordance with claim 1, further comprising the step of allocating to a location more than one stacking compartment.

6. Method in accordance with claim 1, further comprising the step of bringing the containers onto a conveyor belt after transfer for further processing of tile parcels.

7. Method in accordance with claim 1, wherein said performing step includes providing said containers with movable compartment bottoms, said containers being for direct stacking of the parcels.

* * * * *